US005987940A

United States Patent [19]

Chang

[11] Patent Number: 5,987,940

[45] Date of Patent: Nov. 23, 1999

[54] U-SHAPED LOCK

[76] Inventor: Kuo-Chou Chang, P.O. Box 28-24, Kaohsiung, Taiwan

[21] Appl. No.: 08/720,798

[22] Filed: Oct. 1, 1996

[51] Int. Cl.[6] ..... E05B 87/24

[52] U.S. Cl. ..... 70/38 A; 70/39; 70/52; 70/358

[58] Field of Search ..... 70/38 A, 39, 52, 70/358, 375, 493, DIG. 37, DIG. 62

[56] References Cited

U.S. PATENT DOCUMENTS

| | | | |
|---|---|---|---|
| 257,086 | 4/1882 | Shallus | 70/38 A |
| 1,451,860 | 4/1923 | Best | 70/39 |
| 1,548,239 | 8/1925 | Allain | 70/38 A |
| 1,755,847 | 4/1930 | Stevens | 70/493 |
| 1,779,716 | 10/1930 | Shaw | 70/38 A |
| 1,881,809 | 10/1932 | Maxwell | 70/52 |
| 2,199,165 | 4/1940 | Smith | 70/493 X |
| 4,464,915 | 8/1984 | Moshe et al. | 70/52 |
| 5,140,836 | 8/1992 | Hogan et al. | 70/38 A X |
| 5,148,690 | 9/1992 | Wang | 70/358 X |
| 5,230,231 | 7/1993 | Liou | 70/52 X |
| 5,475,997 | 12/1995 | Chung | 70/358 X |

FOREIGN PATENT DOCUMENTS

| | | | |
|---|---|---|---|
| 977988 | 11/1975 | Canada | 70/358 |
| 2462536 | 3/1981 | France | 70/52 |
| 353111 | 5/1922 | Germany | 70/39 |
| 1176516 | 8/1964 | Germany | 70/358 |
| 2706302 | 8/1978 | Germany | 70/39 |
| 383197 | 12/1964 | Switzerland | 70/493 |
| 11362 | 9/1886 | United Kingdom | 70/39 |
| 2054021 | 2/1981 | United Kingdom | 70/38 A |

*Primary Examiner*—Lloyd A. Gall
*Attorney, Agent, or Firm*—Dougherty & Troxell

[57] ABSTRACT

A U-shaped lock includes a housing, a shackle holder and a cap closing the housing. A U-shaped shackle has two ends inserted in two shackle holes in the cap and the shackle holder. A lock unit with a pin tumbler mechanism is fixed in a lock hole of the shackle holder, being rotated for two stages of angles by a key to move a pull rod unit fitted in a horizontal lengthwise hole on the lock hole in the shackle holder outward or inward to lock or unlock the two ends of the shackle.

5 Claims, 6 Drawing Sheets

U-SHAPED LOCK

BACKGROUND OF THE INVENTION

This invention concerns a U-shaped lock, particularly such a lock having reduced weight, and increased anti-theft function.

Conventional U-shaped locks generally include a body formed and operated with a single stage for locking and unlocking, and a U-shaped shackle inserted and locked therein. The shackle has one of its two ends always connected inseparably with the body, with the other end being separated from the body in unlocking. The lock unit pushes a pull rod unit to lock or unlock the shackle. Some U-shaped locks have shackles separable completely from the body when unlocked. The body is made of zinc alloy, aluminum, copper, etc. by a molding process and then its outer surface is treated. The lock unit, the pull rod unit and the shackle are then fitted in relative positions. The lock unit is generally locked or unlocked with one stage of operation for pushing and pulling the pull rod unit to lock or unlock the shackle.

However, the conventional U-shaped locks are deemed to have a drawback in that they are too heavy, even those made of zinc alloy, not to mention those made of copper. Another drawback is that the costs are high, not satisfying economic principles. One more drawback is that their anti-theft function is not so good, so that an experienced thief can easily unlock the lock unit, because of the one stage operation of locking and unlocking the lock unit.

SUMMARY OF THE INVENTION

One feature of the invention is that a housing and a shackle holder kept in the housing are formed by injecting molding process, without the necessity of treating their outer surfaces.

Another feature of the invention is a lock unit that includes a lower lock body having a pin tumbler mechanism and an upper lock body also having a pin tumbler mechanism and located on the lower lock body. In locking or unlocking a key is inserted to rotate the lower lock body for 45 degrees as a first stage of operation and is further inserted to rotate the upper lock body for another 45 degrees together with the lower lock body as a second stage of operation. Thus, the upper lock body can push or pull a pull rod unit to lock or unlock two ends of a shackle from a body of the U-shaped lock.

BRIEF DESCRIPTION OF THE DRAWINGS

This invention will be better understood by reference to the accompanying drawings, wherein.

DESCRIPTION OF THE PREFERRED EMBODIMENTS

Figure 1:
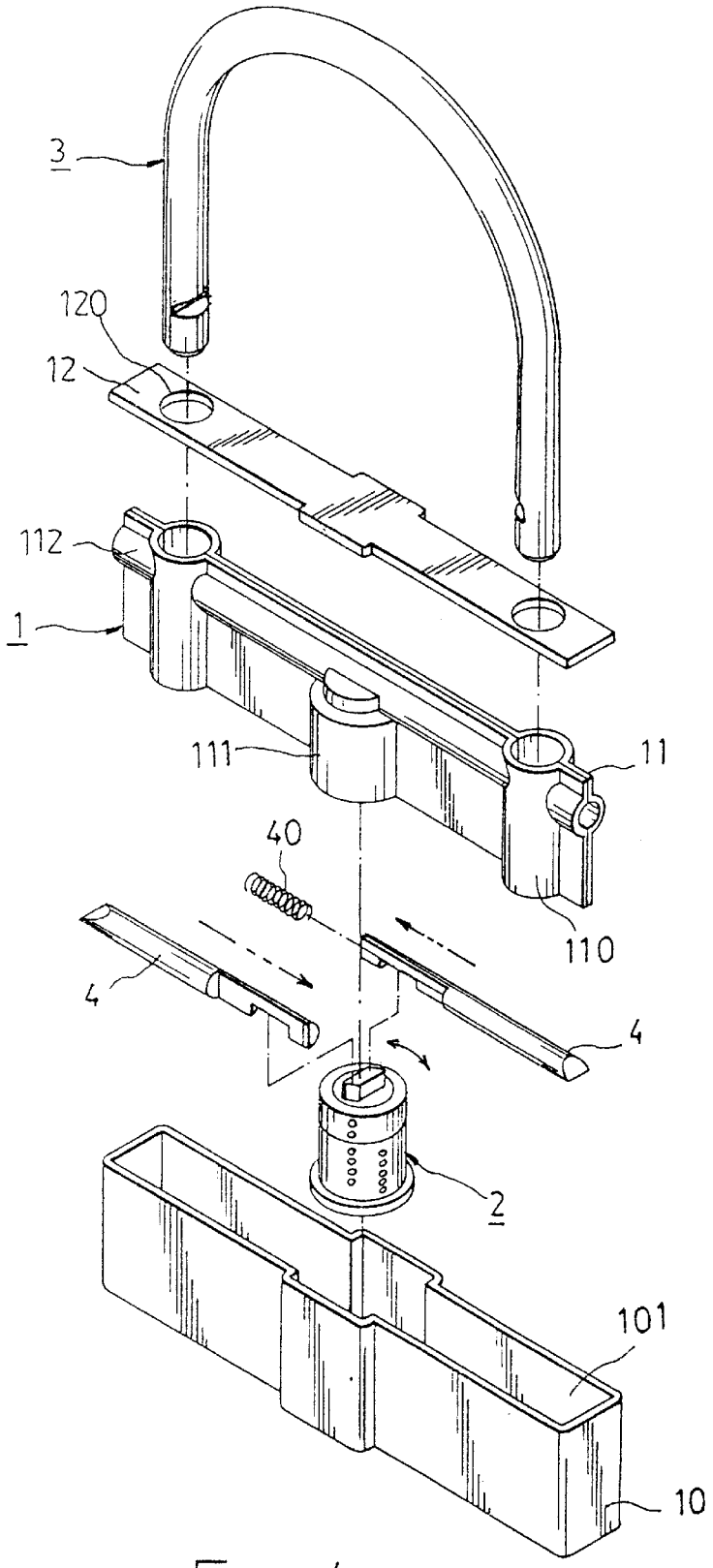
FIG. 1 is an exploded perspective view of a first preferred embodiment of a U-shaped lock of the present invention.
Figure 2:
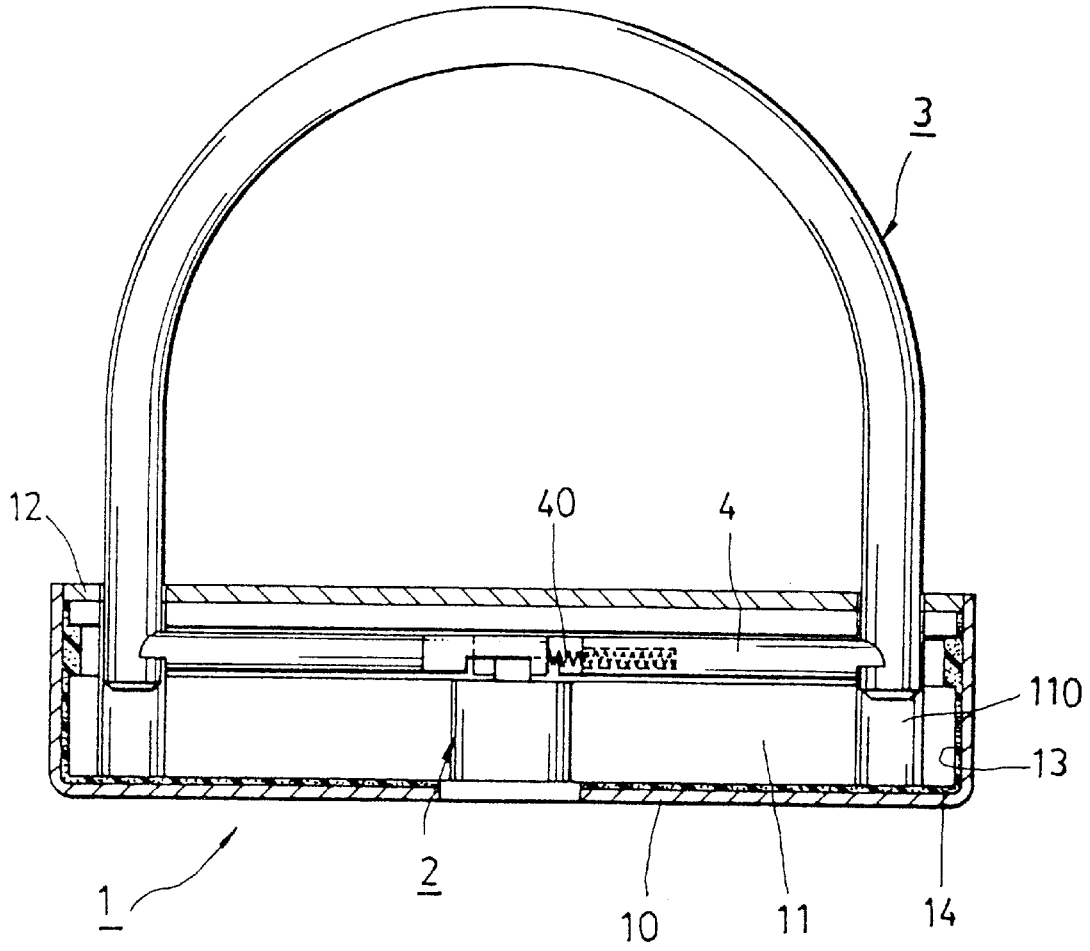
FIG. 2 is a cross-sectional view of the first preferred embodiment of a U-shaped lock of the present invention, showing it in the locked position.

A first preferred embodiment of a U-shaped lock of the present invention, as shown in FIGS. 1 and 2, includes a body 1, a lock unit 2, a U-shaped shackle 3, and a pull rod unit 4 as main components combined together.

The body 1 includes a housing 10, a shackle holder 11 and an elongate cap 12. The housing 10 has a cavity 101 for receiving the shackle holder 11 therein, an open upper side and a closed lower side. The shackle holder 11 has a shackle hole 110 respectively at two sides for two ends of the shackle 3 to fit therein, a lock hole 111 at the center for depositing the lock unit 2 therein and a lengthwise horizontal rod hole 112 for the pull rod unit 4 to fit and move therein. The elongate cap 12 closes on the open upper side of the housing 1, having two shackle holes 120 spaced apart near two ends for the two ends of the shackle 3 to fit through to move in the shackle holes 110 of the shackle holder 11.

As to an aperture 13 formed between the housing 10 and the shackle holder 11, it can be filled with a filling material 14 such as resin, cement, or the like before the cap 12 is fixed in place so that the shackle holder 11 may be secured firmly and immovably in the housing 10.

In assembling this U-shaped lock, firstly, the pull rod unit 4 is inserted into the shackle holder 11, the shackle holder 11 is placed in the housing 10, and then the lock unit 2 is inserted in the lock hole 111. Next, the filling material 14 is filled in the aperture 13. After that, the cap 12 is closed on the upper side of the housing 10, to finish assembling this U-shaped lock. And the shackle 3 may be inserted through the shackle holes 120 of the cap 12 and the shackle holes 110 of the shackle holder 11 for locking.

The housing 10 may be formed by an injecting molding process, without the need to treat its outer surface. The shackle holder 11 may be formed of plural steel pieces pressed to be shaped symmetrical and then combined together, also with its outer surface not needing to be treated.

The lock unit 2, as shown in FIGS. 1, 3, 4, 5 and 6, includes a lock shell 50, a lower lock body 51, an upper lock body 52, a first group of pins 71, a second group of pins 5021, a third group of pins 72, and a fourth group of pins 5221, a first group of springs 70, a second group of springs 5020, and a third group of springs 5220 combined together.

The lock shell 50 is deposited in the lock hole 111 of the shackle holder 11, and has a first group of pin holes 501 (five for example) bored radially oriented and vertically spaced apart equidistantly in its wall for receiving the first group of pins 71 and the first group of springs 70 elastically urging the first group of pins 71 inward therein, a second group of pin holes 502 (six for example) bored radially oriented and vertically spaced apart equidistantly in its wall for receiving the second group of pins 5021, and the second group of springs 5020 elastically urging the second group of pins inward. The first group of pin holes 501 and the second group of pin holes 502 are separated about 45 degrees in a circumferential direction.

The lower lock body 51 is received in a lower portion of the center cavity of the lock shell 50, having the third group of pin holes 510 (five for example) bored radially oriented and vertically spaced apart equidistantly to receive a third group of pins 72 (five for example) therein. The third group of pin holes 510 faces the first group of pin holes 501 of the lock shell 50 when the lower lock body 51 is rotated for about 45 degrees by a key 6. The lower lock body 51 has a first vertical key slot 511 cut from an outer surface to the center for the key 6 to fit therein, and a horizontal slot 512 near the top for one end of a position pin 513 fixed with the lock shell 50 to fit and move therein to let the lock body 51 rotate for about 90 degrees.

The upper lock body 52 has a bottom 520 fitted in an upper portion of the center cavity of the lock shell 50 and located directly on the lower lock body 51, and an upper portion 521 protruding out of the lock shell 50 and contacting and moving the pull rod unit 4. The upper lock body 52 further has a fourth group of pin holes 522 (two, for example) bored radially oriented and vertically spaced apart equidistantly. The fourth group of pin holes 522 faces the uppermost two of the second group of pin holes 502 of the lock shell 50 and in the same vertical line with the same group of pin holes 502 when the upper lock body 52 is in the locked position. The upper lock body 52 has a second vertical key slot 523 cut from an outer surface to the center, and a horizontal slot 524 is bored for one end of a position pin 525 fixed with the lock shell 50 to fit and move therein to let the upper lock body rotate for about 45 degrees.

Figure 3:
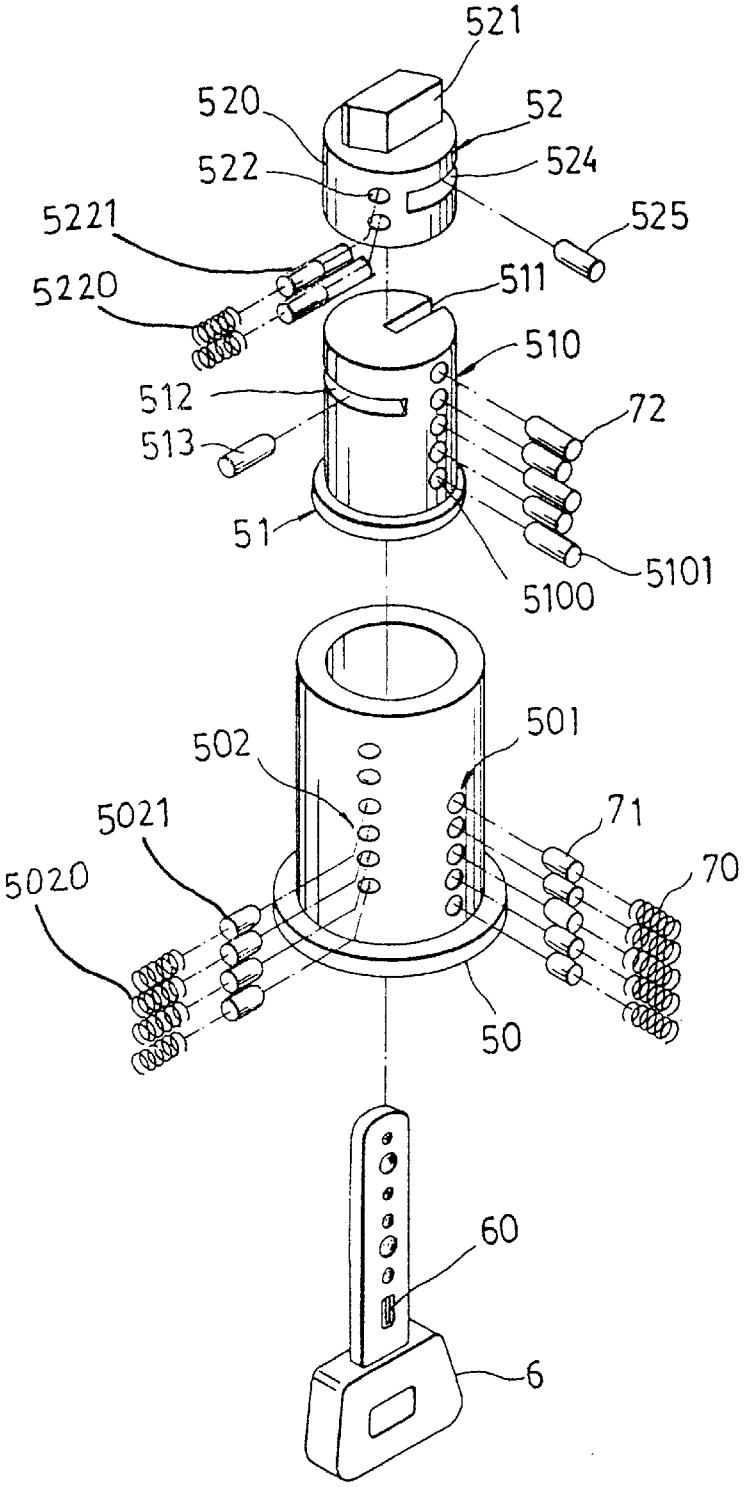
FIG. 3 is an exploded perspective view of a lock unit of the first preferred embodiment of a U-shaped lock of the present invention.
Figure 6:
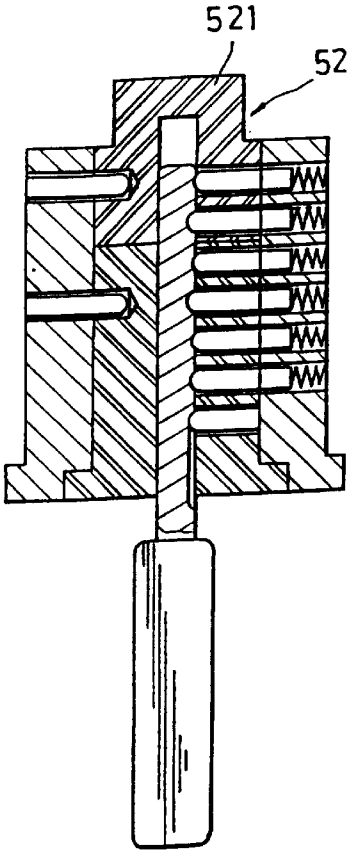
FIG. 6 is a cross-sectional view of the lock unit with the key of the first preferred embodiment of U-shaped lock in the present invention, showing the key inserted in a second key slot in the upper body to rotate the lower and the upper lock body together to perform a second stage of unlocking.

As can be seen in FIG. 3, the number of the first group of pin holes 501 is the same as the third group of pin holes 510, but the number of the second group of pin holes 502 is preferably one less than that of the first group 501 plus the fourth group of pin holes 522 so that a lowest pin 5101 in a lowest pin hole 5100 of the third group of pin holes 510 can fit in a low slot 60 of the key 6, limiting the movement of key 6 up and down and preventing the key 6 from dropping out or moving too high or low.

Further, the first key slot 511 of the lower lock body 51 is separated from the second key slot 523 of the upper lock body 52 with the same angle, 45 degrees as that of the first group of pin holes 501 separated from the second group of pin holes 502 in the lock shell 50.

The length of the horizontal slot 512 of the lower lock body 51 is longer than that of the horizontal slot 524 of the upper body 52, which allows the upper lock body 52 to rotate for about 45 degrees, so that the lower lock body 51 may rotate for more than 45 degrees, namely for about 90 degrees.

Figure 5:
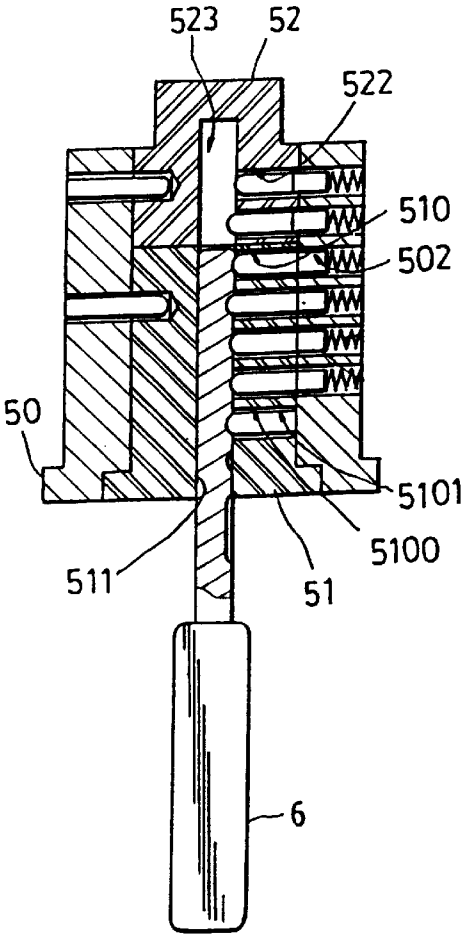
FIG. 5 is a cross-sectional view of the lock unit with the key of the first preferred embodiment of a U-shaped lock in the present invention, showing the lower lock body rotated for 45 degrees by the key and finishing a first stage of unlocking.
Figure 4:
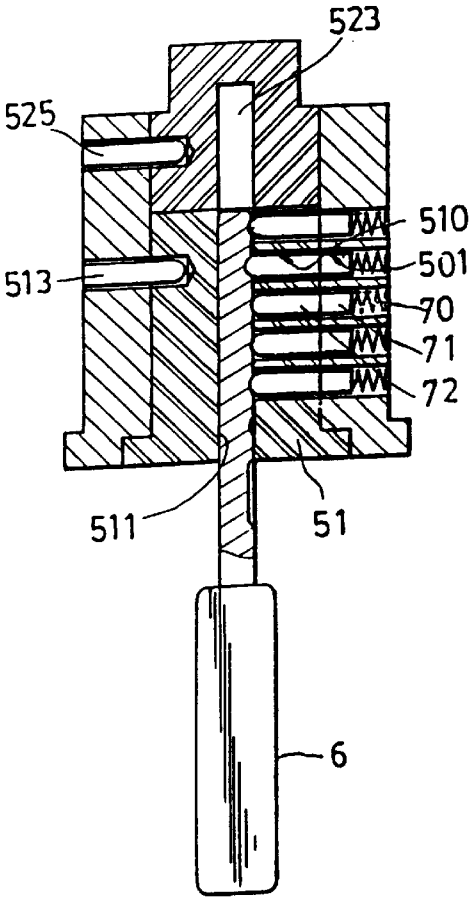
FIG. 4 is a cross-sectional view of the lock unit of the first preferred embodiment of a U-shaped lock of the present invention, showing a key inserted in a first key slot in a lower lock body.

Next, how this lock is unlocked after being locked is described. Referring to FIG. 4, firstly, the key 6 is inserted only in the first key slot 511 of the lower lock body 51, and is unable to move into the second slot 523 of the upper lock body 52 owing to the angle difference of the position of the two lock bodies 51 and 52. Then the key 6 pushes outward the third group of pins 72, except the lowest one 5101, and the first group of pins 71 except the lowest one, permitting the lower lock body 51 to rotate relative to the lock shell 50. Then the lower lock body is rotated for about 45 degrees by the key 6 as FIG. 5 shows, with the third group of pin holes 510 moving to face to the four lower ones of the second group of pin holes 502 and the fourth group of pin holes 522 of the upper lock body 52 in a vertical straight line, and with the first key slot 511 moving in vertical alignment with the second key slot 523. Then the key 6 can be further pushed in the second key slot 523, pushing outward the fourth group of pins 5221 in the fourth group of pin holes 522, the uppermost two of the second group of pins 5021 and the uppermost two of the second group of springs 5020 in the second group of pin holes 502 of the lock shell 50 so that the upper lock body 52 together with the lower lock body 51 may be rotated for a further 45 degrees. At the same time the key 6 is kept in a secured position by the lowest pin 5101 in the lowest hole 5100 of the third group of pin holes 510 of the lower lock body 51, rendering it unable to loosen and drop out of the key slots 511 and 523. Now referring to FIGS. 6, 1 and 2, the upper portion 521 of the upper lock body 52 moves the two pull rods 4, which then move inward to disengage their outer ends from the two ends of the shackle 3 with the spring 40 compressed. Then the shackle 3 can be pulled out of the shackle holder 11, which means this lock is unlocked. The arrows and the dotted lines in FIGS. 1 and 2 show the movement of the upper portion 521 of the upper lock body 52 and the pull rods 4. When the spring 40 recovers its resilience with the key released manually, it resiliently pushes the pull rods 4 back to the original (locking) position with the upper lock body 52 also rotated for about 45 degrees automatically.

The locking operation can be understood from the unlocking process just described, and need not be further described.

Thus two stages of the key operation in locking and unlocking surely prevents the whole lock unit 5 from being broken or pried open, with the upper lock body 52 impossible to be illegally rotated by thieves for disengaging the pull rods 4 from the shackle 3.

Figure 7:
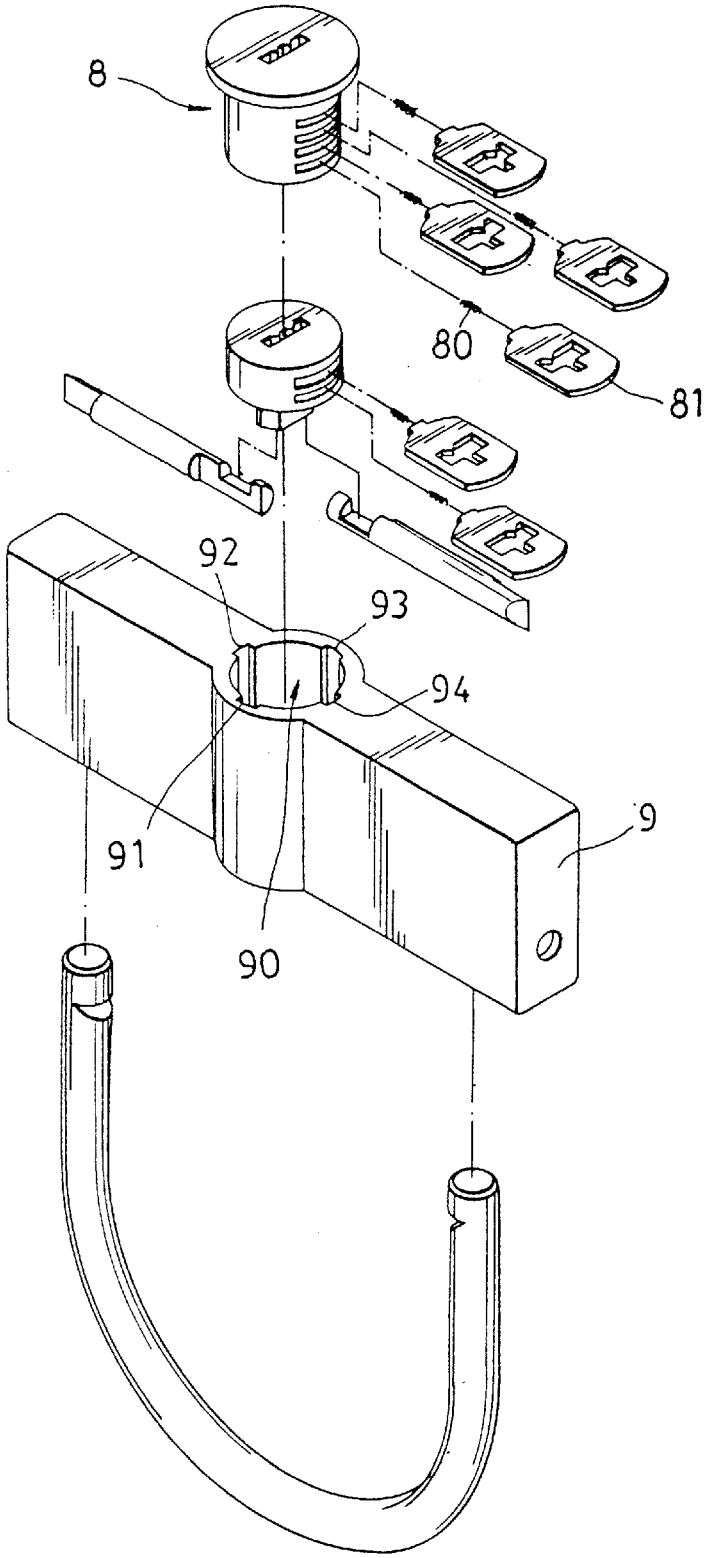
FIG. 7 is an exploded perspective view of a second preferred embodiment of a U-shaped lock of the present invention.

A second preferred embodiment shown in FIG. 7 includes a first group of springs 80 and a first group of thin chips 81 instead of the first group of springs 70 and the first group of pins 71 of the first preferred embodiment. A body 9 has a lock hole in the center 90 for fitting a lock unit 8 therein. The lock unit 8 has a lower lock body and an upper lock body with chip holes vertically arranged for the chips 81 to fit and move therein. The wall of the lock hole 90 also has vertical chip grooves 91, 92, 93, 94 spaced apart equidistantly and vertically to correspond to the chip holes of the lower and upper lock bodies. The second embodiment also has two stages of locking and unlocking operation as the first embodiment.

Figure 8:
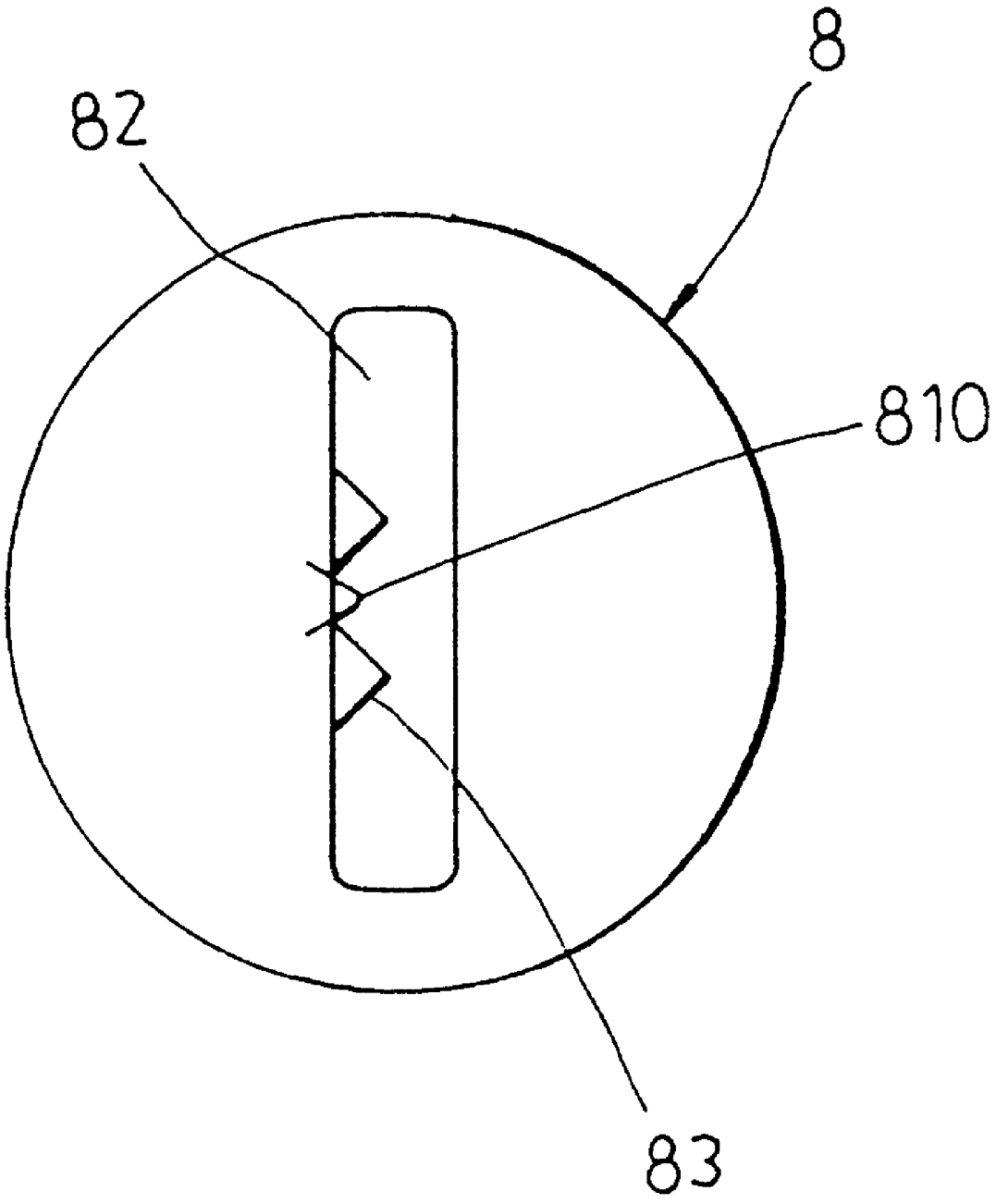
FIG. 8 is an elevational view of a key slot and a tooth of a thin chip of a third preferred embodiment of a U-shaped lock of the present invention.

A third preferred embodiment of the invention shown in FIG. 8, has the same structure as the second embodiment except for a lock unit 8, which includes a key slot 82, and a plurality of tooth-shaped protect projections 83 arranged with every two of them located at opposite sides of a tooth 810 of each chip 81 so as to prevent the lock unit from being broken or pried open.

While the preferred embodiments of the invention have been described above, it will be recognized and understood that various modifications may be made therein and the appended claims are intended to cover all such modifications which may fall within the spirit and scope of the invention.

What is claimed is:

1. A U-shaped lock comprising:

an elongate housing having peripheral walls, an open upper side, and a closed lower side;

a shackle holder mounted within said elongate housing and having a lock hole in a center for receiving a lock unit therein, the shackle holder further having a wall bounding an elongated cylindrical opening at opposite ends of the shackle holder and a wall bounding an elongated lengthwise pull rod hole, the lengthwise pull rod hole opening into the cylindrical openings at opposite ends of the shackle holder and the lock hole wherein said shackle holder comprises two symmetrical pieces attached together, without treating an outer surface of the shackle holder;

an elongate cap attached to said elongate housing to enclose said shackle holder therein, said elongate cap having a shackle hole respectively in opposite ends aligned with the cylindrical opening in opposite ends of said shackle holder;

a lock unit mounted in said lock hole of said shackle holder;

a U-shaped shackle having two opposite ends, one end received in each of the elongated cylindrical openings of the shackle holder such that the opposite ends are within the wall bounding the cylindrical openings and the peripheral walls of the housing; and, pull rods located in the lengthwise pull rod hole and attached to the lock unit such that, when the lock unit is in a first position, the pull rods engage the ends of the U-shaped shackle to lock the shackle into the housing, and when the lock unit is in a second position, the pull rods are disengaged from the ends of the shackle enabling the shackle to be removed from the housing.

2. The U-shaped lock as claimed in claim 1, wherein a space between said housing and said shackle holder is filled with reinforcing material for securing said shackle holder tightly in said housing.

3. A U-shaped lock comprising;

an elongate housing having a cavity with an open upper side and a closed lower side;

a shackle holder mounted in said cavity and having a lock hole in a center, a shackle hole respectively in each of two opposite ends, and a lengthwise hole;

an elongate cap attached to said housing so as to close the open upper side of said housing;

a U-shaped shackle having two opposite ends inserted into said shackle holes of said shackle holder in said housing;

a pull rod unit having two pull rods arranged in a straight line and a spring located between and acting on said two pull rods;

a lock unit mounted in the lock hole of said shackle holder and comprising:

a hollow lock shell having a first group of pin holes radially oriented and vertically spaced apart equidistantly, a second group of pin holes radially oriented and vertically spaced apart equidistantly, said first group and said second group of pin holes being separated by about 45 degrees in a circumferential direction, a first group of pins movably inserted in said first group of pin holes, a first group of springs acting on said first group of pins and elastically urging said first group of pins inwardly in said first group of pin holes, a second group of pins movably inserted in said second group of pin holes, and a second group of springs acting on and urging said second group of pins inwardly in said second group of pin holes;

a lower lock body having a transverse slot movably engaging a position pin fixed to said lock shell to permit said lower lock body to rotate approximately 90 degrees, a first longitudinal key slot from an outer surface to a center, a third group of pin holes radially oriented and vertically spaced apart equidistantly, a third group of pins movably inserted in said third group of pin holes, said third group of pin holes facing said first group of pin holes of said lock shell with said third group of pins protruding into said first key slot when said lower lock body is in a locked position, said third group of pins protruding into said first key slot being pushed by a key to let said lower lock body rotate relative to said lock shell when the key is inserted into said first key slot, said third group of pin holes facing said second group of pin holes of said lock shell when said lower lock body is rotated for about 45 degrees by the key;

an upper lock body located in an inner cavity of said lock shell, a horizontal slot for a position pin fixed with said lock shell to fit and move therein to let said upper lock body rotate for approximately 45 degrees relative to said lock shell, a second longitudinal key slot bored from an outer surface to a center, an upper portion protruding out of said lock shell and engaging said two pull rods, a fourth group of pin holes radially oriented and vertically spaced apart equidistantly, said fourth group of pin holes movably receiving a fourth group of pins, said fourth group of pins protruding into an inner cavity of said lock shell when said upper lock body is in the locked position, said fourth group of pin holes facing said second group of pin holes of said lock shell when the lock unit is in the locked position, said fourth group of pins being pushed into said fourth group of pin holes to let said upper lock body rotate approximately 45 degrees when said key is further pushed into said second key slot, said upper lock body together with said lower lock body being rotated for approximately 45 degrees enabling said upper portion to disengage said pull rods from said two ends of said shackle so that said shackle may be pulled out of said shackle holes of said shackle holder.

4. The U-shaped lock claimed in claim 3, wherein the number of pin holes in said first group of pin holes is the same as the number of pin holes in said third group of pin holes, and the number of pin holes in said second group of pin holes is one less than the number of pin holes in said first group of pin holes plus said fourth group of pin holes so that a lowest pin in a lowest pin hole of said third group of pin holes protrudes in a low slot of said key.

5. The U-shaped lock claimed in claim 3, wherein said first key slot in said lower lock body and said second key slot in said upper lock body are located at an angle of approximately 45 degrees from each other in the locked position and that angle is the same as the angle between said first group and said second group of pin holes of said lock shell.

* * * * *